US006595104B2

(12) United States Patent
Pinciaro

(10) Patent No.: US 6,595,104 B2
(45) Date of Patent: Jul. 22, 2003

(54) PILOT CONTROL FOR A HOIST AND BALANCING APPARATUS

(75) Inventor: William Pinciaro, Tampa, FL (US)

(73) Assignee: Tri Motion Industries of Florida, Tampa, FL (US)

( * ) Notice: Subject to any disclaimer, the term of this patent is extended or adjusted under 35 U.S.C. 154(b) by 0 days.

(21) Appl. No.: 09/965,616

(22) Filed: Sep. 27, 2001

(65) Prior Publication Data

US 2003/0056644 A1 Mar. 27, 2003

(51) Int. Cl.[7] ..... F15B 13/04
(52) U.S. Cl. ..... 91/461; 91/462; 137/596.14
(58) Field of Search ..... 91/444, 453, 428, 91/461, 462; 137/596.14, 596.2, 625.69, 614.21

(56) References Cited

U.S. PATENT DOCUMENTS

| | | | | | |
|---|---|---|---|---|---|
| 2,974,639 | A | * | 3/1961 | O'Connor et al. | 91/461 X |
| 3,537,686 | A | | 11/1970 | McKendrick | 254/168 |
| 3,554,091 | A | * | 1/1971 | Spyridakis et al. | 137/596.2 |
| 3,675,899 | A | | 7/1972 | McKendrick | 254/168 |
| 3,933,388 | A | * | 1/1976 | Conboy | 254/270 |
| 4,243,060 | A | | 1/1981 | McKendrick | 137/625.69 |
| 4,445,538 | A | | 5/1984 | Bilski | 137/596.2 |
| 4,748,896 | A | * | 6/1988 | Ott et al. | 137/596.14 |
| 4,831,825 | A | * | 5/1989 | Jeschke | 91/444 X |
| 5,110,085 | A | * | 5/1992 | Iwasawa | 91/461 X |
| 5,725,199 | A | * | 3/1998 | Yamamoto | 254/360 |
| 5,772,184 | A | * | 6/1998 | Zaguroli, Jr. | 251/294 |
| 5,984,276 | A | | 11/1999 | Green | |

FOREIGN PATENT DOCUMENTS

| | | |
|---|---|---|
| GB | 1 489 862 | 10/1977 |

* cited by examiner

*Primary Examiner*—Edward K. Look
*Assistant Examiner*—Thomas E. Lazo
(74) *Attorney, Agent, or Firm*—Gifford, Krass, Groh, Sprinkle, Anderson & Citkowski, P.C.

(57) ABSTRACT

An actuator assembly has a first and second pilot valve. Each valve has inlets in communication with a fluid supply source and outlets in communication with the control valve. An in-line actuator housing disposed between the fluid powered device and a low connector supports the pilot valves. An elongated sleeve being axially slidably mounted over the in-line housing covers the in-line housing. A radially extending actuating member is coupled to the elongated sleeve whereby movement of the sleeve in one direction operates the first pilot valve to provide a fluid pressure necessary to actuate a first portion of the control valve so that fluid pressure is introduced into the fluid-powered device on the front side of the piston, and movement of the sleeve in the opposite direction causes operation of the second pilot valve so that fluid pressure is introduced into the fluid powered device on the back side of the piston causing the fluid powered device to move in a direction opposite of the first direction.

12 Claims, 4 Drawing Sheets

PILOT CONTROL FOR A HOIST AND BALANCING APPARATUS

FIELD OF THE INVENTION

The present invention relates generally to fluid control valves and, more particularly, to a piloted control valve used to deliver fluid pressure to a fluid pressure powered device.

BACKGROUND OF THE INVENTION

Fluid powered devices, such as fluid powered lifts and jacks, are widely employed in the industry. Such devices are typically pneumatically or hydronically powered and include an expansible chamber or fluid powered motor for converting pressurized flow to mechanical movement. Thus, by connecting the device to a source of fluid pressure, the fluid device produces mechanical movement in one direction while, conversely, exhaustion of the fluid pressure from the fluid powered device produces mechanical movement in the opposite direction.

In order to pressurize the fluid powered device at the desired level, hereby a directional control valve is usually connected between a source of fluid pressure and the fluid powered device. The control valves are selectively operable to connect a fluid powered device with the source of the fluid pressure or, alternatively, to exhaust pressurized fluid from the fluid powered device. Such previously known values are conventionally actuated by solenoids, hand levers, push buttons, foot paddles and the like.

These previously known bi-directional control valves, however, have not proven entirely satisfactory in use. One disadvantage of the previously known bi-directional control valves is that the value member must be manually moved to a neutral closed position following actuation. Failure to do so, however, requires the reverse operation of the bidirectional control valve in order to return the fluid device to the desired position.

A still further disadvantage of many of the previously known bi-directional valves, and, particularly, solenoid actuated valves, is that while the direction of fluid flow through the valve is controllable, the flow rate is not. Consequently, with these types of previously known control valves, accurate positioning of the fluid powered device is difficult if not altogether impossible. Moreover, when an accurate position of the fluid powered device is required, the control valve must be actuated in a reiterative fashion until the desired position of the fluid device is obtained. Such a reiterative process is time-consuming in practice and, therefore, costly.

A still further disadvantage of many of the previously known manually operated bi-directional control valves is that the control valve itself must be manually unseated against a force of the fluid pressure. Consequently, when the valve is used to control high-pressure fluids forces, it is difficult for the operator to manually unseat the valve against the force of this fluid pressure. Furthermore, when the degree of actuation of the control valve is used to control the flow rate through the control valve, accurate actuation of the control valve, and thus accurate positioning of the fluid powered device, is difficult to achieve.

SUMMARY OF THE INVENTION

The present invention is an apparatus and method of actuating a fluid control valve for use with a fluid powered device of the type disposed with a fluid pressure responsive member that is axially moveable therein. In the preferred embodiment, the pressure responsive member is a pressure driven piston having a front side and a back side.

The fluid control valve connects the fluid powered device to the fluid supply source. Further, the control valve includes at least one adjustable flow control port for use in controlling the speed of operation of the fluid powered device.

The actuator assembly includes a first and second pilot valve, an in-line actuator housing and an elongated sleeve being axially slidably mounted over the in-line housing. The first and second pilot valves have inlets in communication with the fluid supply source and outlets in communication with the fluid control valve. The pilot valves are fixably attached and supported on the in-line actuator housing in an axially adjacent manner such that the first pilot valve mirrors the second pilot valve. The design of the in-line actuator housing allows for very slim diameter hosing to be attached to the inlet and outlet portions of the pilot valves whereby the pilot valves are in fluid communication with the fluid supply source, as well as the control valve.

The elongated sleeve is axially slidably mounted over the in-line actuator housing such that an opening disposed midway between its opposite ends is positioned directly over the small space between the first and second pilot valve in the in-line actuator housing. The opening in the elongated sleeve is adapted to receive a radially extending actuating member, such as an actuating plate. The actuating member is secured into position with a retaining screw that fixedly attaches to the opening. Further, the elongated sleeve is prevented from axial rotation by a guide screw located at either end of the elongated sleeve. Although the elongated sleeve is prevented from rotational movement, it is not prevented from translational movement along the axis. As such, when the elongated sleeve is moved in one axial direction, the actuator plate will engage the first pilot valve causing its operation whereby a fluid pressure necessary to actuate a first portion of the control valve is provided such that fluid pressure is introduced into the fluid powered device causing the piston to move in a first direction and, upon moving the elongated sleeve in an opposite direction, the operation of the second pilot valve provides a fluid pressure necessary to actuate a second portion of the control valve so that a fluid pressure is introduced into the fluid powered device causing the piston to move in an opposite direction.

BRIEF DESCRIPTION OF THE DRAWINGS

The following detailed description of the invention will be more readily understood when considered together with the accompanying drawings in which.

DETAILED DESCRIPTION OF THE PREFERRED EMBODIMENTS

Figure 1:
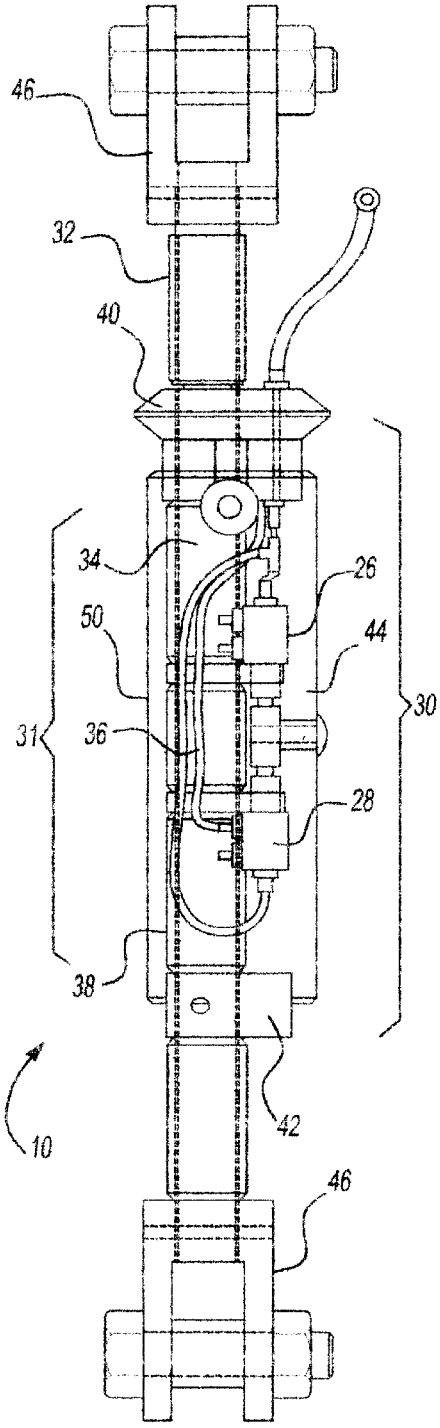
FIG. 1 is a planar view of the actuator assembly as according to the invention.
Figure 2:
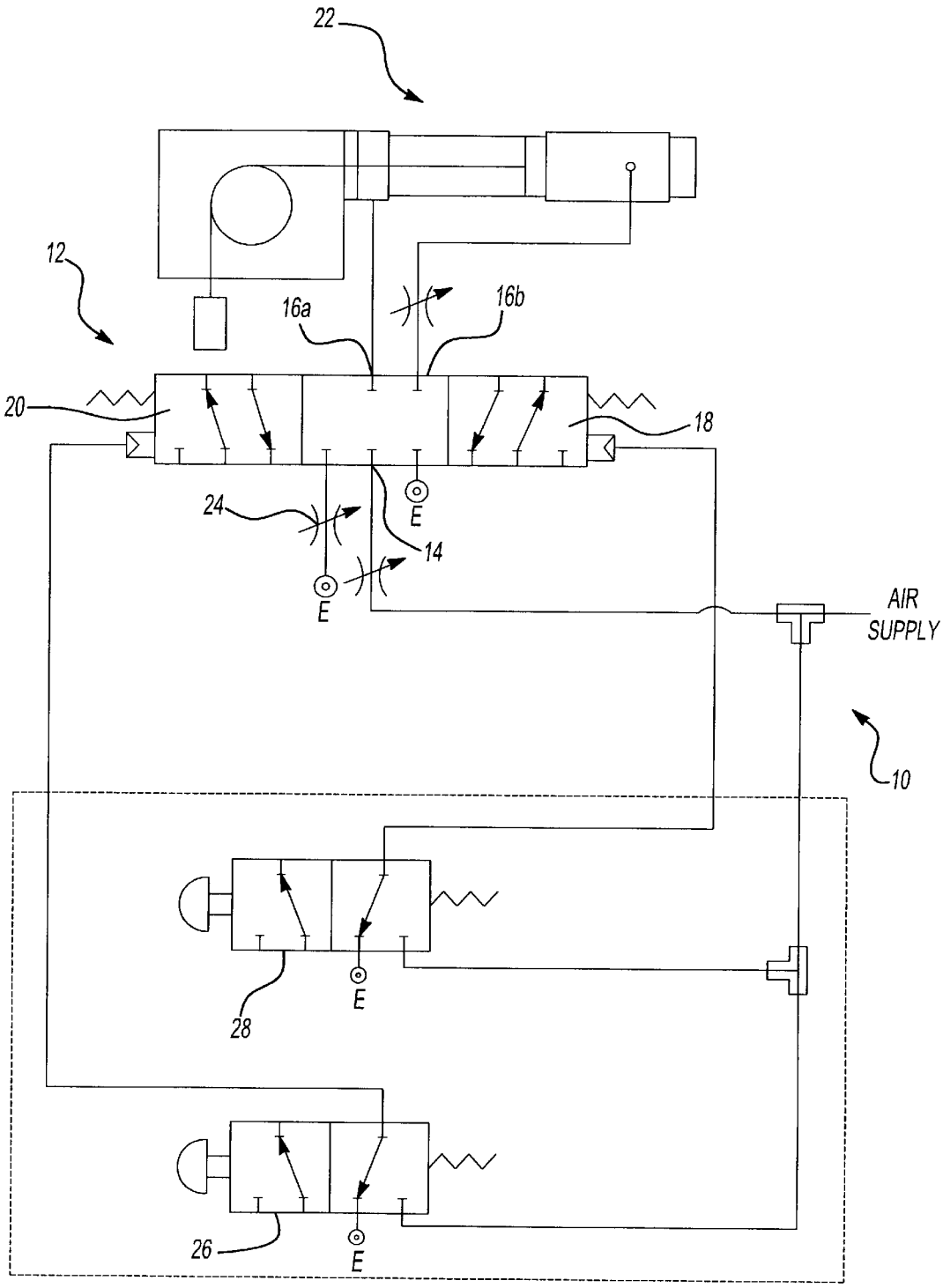
FIG. 2 is a diagrammatic view of the system connections as according to the invention.

With reference to FIGS. 1 and 2, a preferred embodiment of actuator assembly 10 according to the present invention is shown and comprises an in-line actuator housing 30, a top sleeve guide 40, a bottom sleeve guide 42 and a housing body 31. The housing body 31 is formed of three internally threaded lands disposed axially between the top guide 40 and the bottom guide 42 whereby a top land 34 is positioned adjacent to the top guide 40, a bottom land 38 is positioned adjacent to the bottom guide 42 and a middle land 36 is disposed there between.

As are the three land portions, the top and bottom guides for the sleeve are internally threaded for receipt of a threaded member as a means of connecting the individual portions of the in-line actuator housing. Additional lands are connected at the opposite ends of the in-line actuator housing 30 to portions of the elongated threaded member that extend beyond the top and bottom guides. These lands serve as spacers between the top and bottom sleeve guides and top and bottom clevis members 46, respectively. The clevis members are threadably attached to the extreme opposite ends of the elongated threaded member whereby the top clevis member attaches to the cable of a fluid powered device and the bottom clevis member attaches to a load attachment means, such as a hook.

Figure 4B:
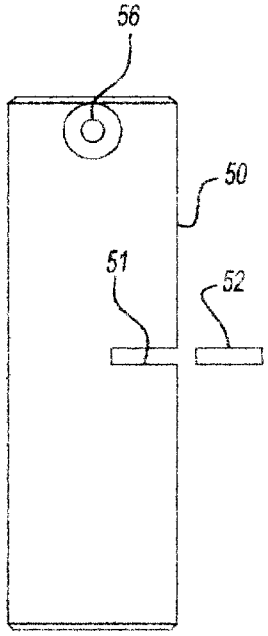
FIG. 4 is a detailed view of the in-line actuator housing and the elongated sleeve.
Figure 4A:
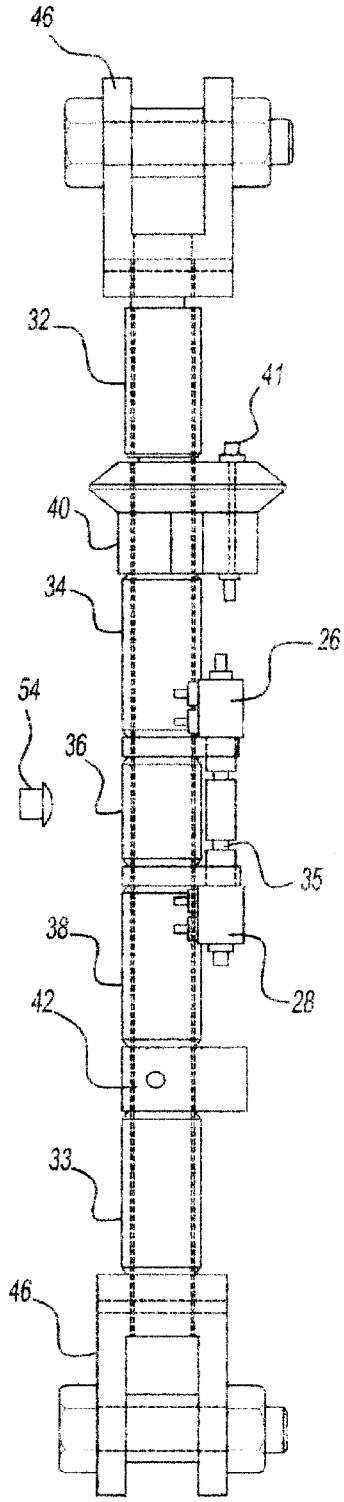

Before connecting the bottom clevis member, a housing cover 50 is disposed over the in-line actuator housing (refers to FIGS. 1 and 4). The housing cover 50 is an elongated sleeve adapted for slip-fit mounting over the top and bottom sleeve guides. Further, the housing cover 50 has an opening 51 disposed midway between its opposite ends such that when it is properly fitted over the top 40 and bottom 42 sleeve guides, the opening 51 is in direct alignment with the spacing 35 between the first 26 and second 28 pilot valves. The housing cover 50 is prevented from axial rotation by a guide screw 56 mounted at an end adjacent the top sleeve guide 40. Finally, the opening 51 in the housing cover 50 is dimensioned to receive an actuating member 52 therein and into the space 35 between the first 26 and second 28 pilot valves. The actuating member 52 is securely held in position by a retaining screw 54 that fixably attaches to the opening 51 by a conventional fastening means, such as threadable engagement, press fit, or other means familiar to those skilled in the art.

The top guide 46 for the sleeve is further disposed with an axial throughbore or having fluid supply hose connectors supported at its opposite ends.

Referencing FIGS. 1 and 4, first and second pilot valves are shown fixably supported to the body of the in-line actuator housing 30 whereby they are axially adjacent to one another in a mirrored orientation as shown in FIG. 4. The first 26 and second pilot valve 28 are fixably mounted adjacent the opposite end of the middle land 36 of the in-line actuator housing 30, such that a pre-determined space 35 is left between the valve buttons for the purpose to be described below.

The first 26 and second pilot valve 28 each have their inlets fluidly attached to the fluid supply source and their outlets fluidly attached to separate portions of a control valve such that actuation of the first pilot valve controls operation of a first portion of the control valve and actuation of the second pilot valve controls operation of a second portion of the control valve. Preferably, the pilot valves are fluidly attached to the fluid supply source and the control valve through a three-ribbon hose designed to handle the small volume of fluid pressure necessary to actuate the control valve.

As shown in the diagrammatic view in FIG. 2, the first 26 and second 28 pilot valves are in fluid communication with a fluid supply source and the control valve 12, and the control valve 12 is in further communication with the fluid powered device 22. In the preferred embodiment, the actuation of a control valve 12 is controlled by the first 26 and second 28 pilot valves that deliver the small volumes of fluid pressure necessary to cause such actuation from the fluid supply source. When actuated, the control valve 12 operates to deliver large volumes of fluid pressure to the fluid powered device 22 through a portion of the control valve determined by the actuation of either the first 26 or second 28 pilot valve. Hence, the preferred embodiment of the present invention uses small volumes of air pressure to control the flow of large volumes of fluid pressure into the fluid powered device. Consequently, because the pilot valves and the control valves share the same fluid supply source, a loss of fluid supply to the control valve also means a loss of fluid supply to the pilot valves. This provides the present invention with an inherent safety system whereby upon loss of the fluid supply source, the pilot valves will not be able to actuate the control valve 12 to change the volume of pressure held in the fluid powered device 22. Therefore, if a load is attached to the fluid powered device 22, when a loss of the fluid supply source occurs, damage or injury due to the dropping of the load will be prevented because the fluid powered device 22 will be fixed or maintained in the state it was just prior to the loss of the fluid supply source.

Under normal conditions, actuation of portions of the control valve 12 is accomplished by axially slidably moving the housing cover 50 of the in-line actuator assembly 30 in a first direction causing the first pilot valve 26 to provide the fluid pressure necessary to cause such actuation of a first portion 18 of the control valve thereby allowing the control valve 12 to introduce a fluid pressure into the fluid powered device 22 causing cause a movement in a first direction. Alternatively, axial movement in a direction opposite of the first direction causes the second pilot valve 28 to operate to provide a fluid pressure as necessary to actuate a second portion 20 of the control valve 12 which introduces fluid pressure into the fluid powered device causing movement in a direction opposite of the first direction.

Figure 3:
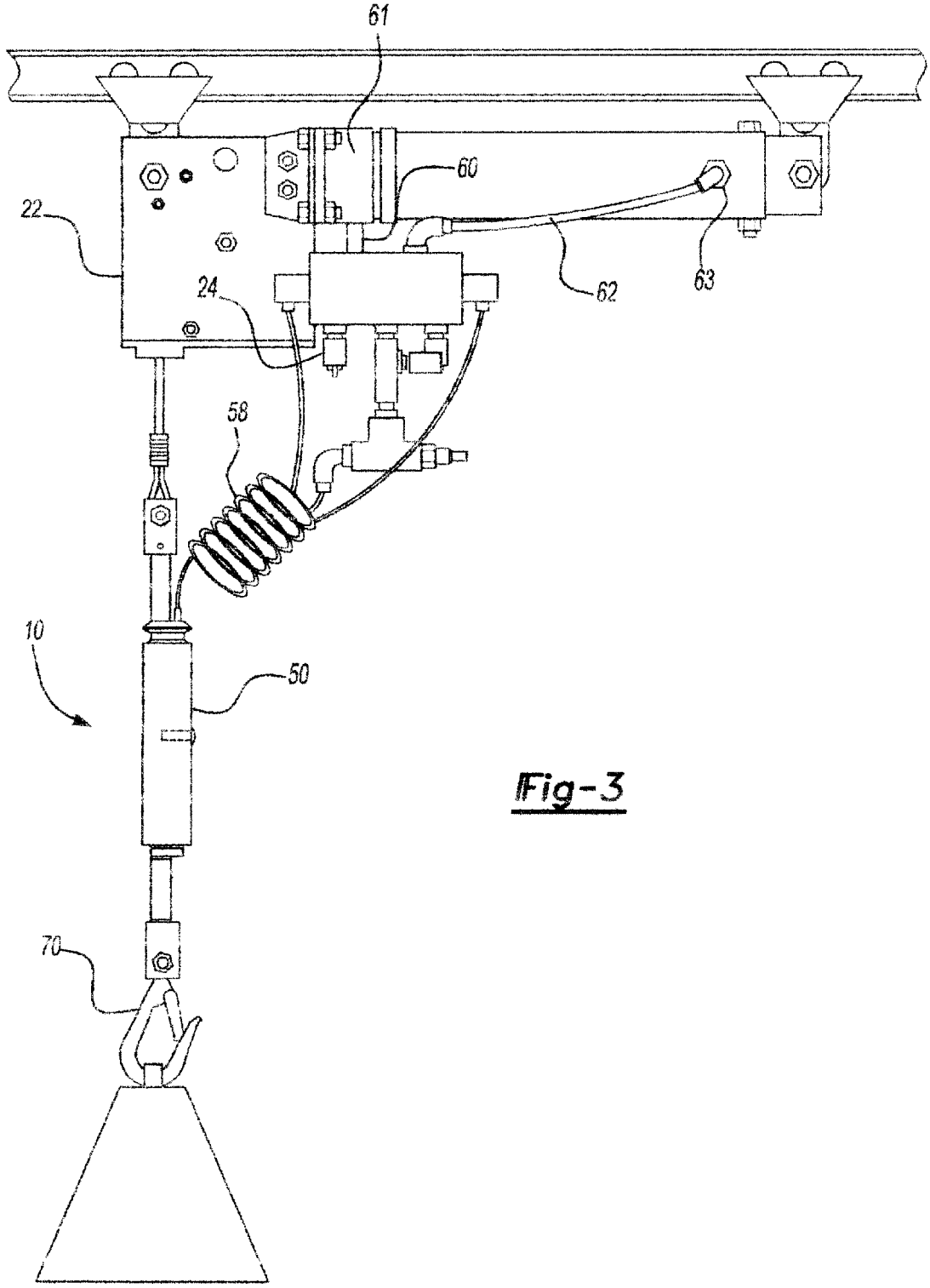
FIG. 3 is an illustrative view of the system as according to the invention.

As shown in FIGS. 2 and 3, the control valve 12 is in fluid communication with the fluid powered device 22 through pressure hoses adapted to handle large volumes of air pressure. As shown in FIG. 3, a first pressure hose 60 delivers fluid pressure from the control valve into a first end 61 of the fluid powered device 22 while a second hose 62 delivers fluid pressure from the control valve 12 to a second end 63 of the fluid powered device.

Disposed within the fluid powered device 22 is a fluid pressure response member (not shown), such as a piston having a front and a back face. Fluid pressure delivered to a first end 61 of the fluid powered device 22 causes fluid pressure on a front side of the fluid response member causing movement in a first direction and fluid pressure delivered to a second end 63 of the fluid powered device 22 causes fluid pressure to be delivered to a back side of the piston causing movement in the opposite direction. Delivering fluid pressure to the fluid pressure response member in this manner enables the lifting or lowering of an attached load, or the cable and hook alone, without any physical force required by the operator except the force required to axially move the housing cover 50 in a first or second direction to cause the operation of either the first 26 or second 28 pilot valve.

Figure 5:
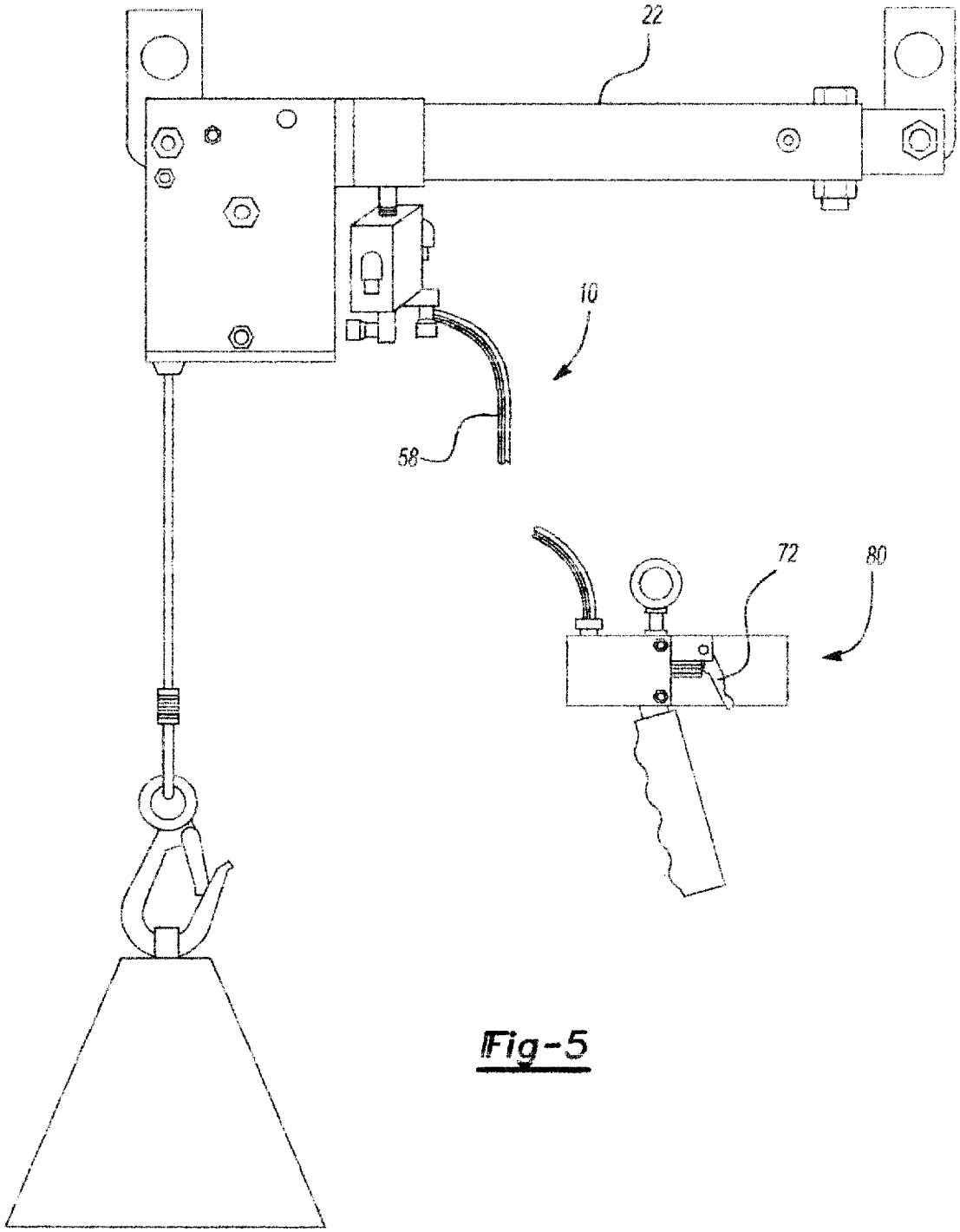
FIG. 5 is a planar view of an alternative embodiment according to the invention.

As shown in FIG. 5, an alternative embodiment 10 uses a hand held remote actuator 80 to cause manipulation of the control valve 12. Disposed in a hand held actuation assembly 80 are the first 26 and second 28 pilot valves. Each pilot valve is mechanically connected to a thumb lever 72 used to operate each pilot valve individually. The pilot valves are in communication with the fluid supply source and a control valve 12 through a three-ribbon, low-pressure hose 58. The hand held assembly 80 operates to apply the pressure necessary for actuation of certain portions of the control valve 12 depending upon which pilot valve thumb lever 72 is actuated. Actuation of a first thumb lever 72 will cause movement of an attached load in a first direction while actuation of the second thumb lever (not shown) will cause movement of an attached load in a direction opposite of the first.

In the preferred embodiment, the control valve 12 is a dual pilot fourway valve that allows actuation of a first portion 18 of the control valve mutually independent of the second portion 20 of such valve.

All of the valves used in the present invention are of the type familiar to those skilled in the art as are the various pressure hoses and connections needed to establish the proper fluid communication. As an added feature, the control valve 12 may include at least one adjustable flow control 24 (See FIG. 3) whereby the speed of operation of the fluid powered device 22 can be variably adjusted by use of the flow control 24 which acts to cause a restriction on the flow of fluid pressure being introduced into the fluid powered device 22 or exhausted from the fluid powered device 22 through the control valve 12. In the preferred embodiment, the fluid supply source is a compressed air supply source.

In operation, the movement of the fluid powered device 22 can be controlled in the following manner. Using the in-line actuator assembly 30, the user can cause movement of the fluid powered device 22 in a first direction by grasping the housing cover 50 with one hand and axially moving the elongated sleeve cover 50 in a first direction which causes actuation of a first pilot valve 26 that provides the pressure necessary for actuating a first portion 18 of the fluid control valve 12 so that fluid pressure can be introduced on the front side of a piston disposed within the fluid powered device 22. To cause movement in the opposite direction, the user simply moves the elongated sleeve cover 50 in the opposite direction causing actuation of a second pilot valve 28 that provides the pressure necessary to operate a second portion 20 of the control valve 12 which allows fluid pressure to be introduced on a back side of the piston causing movement in an opposite direction.

To balance a load, the user simply positions the housing cover 50 in a neutral position whereby neither the first 26 nor the second 28 pilot valve is being actuated such as to cause a pressure to be delivered to the control valve 12.

In the alternative embodiment, the hand held remote actuator 80 is utilized to cause the movement of the fluid powered device 22 in the manner described above simply by actuating a first pilot valve 26 to cause movement in a first direction or the second pilot valve 28 to cause movement in the opposite direction.

Having described the invention, it may occur that many modifications thereto will become apparent to those skilled in the art to which it pertains without deviation of the spirit of the invention as described by the scope of independent claims.

I claim:

1. An actuator assembly for use with a fluid control valve having an inlet in communication with a fluid supply source and an outlet in communication with a fluid powered device, said fluid control valve being in further communication with at least one adjustable flow control port, said fluid powered device having a pressure driven piston disposed therein, said pressure driven piston having a front side and a back side, said actuator assembly having a first and a second pilot valve, said first and second pilot valves having inlets in communication with said fluid supply source and outlets in communication with said control valve, wherein the improvement in said assembly comprises:

an in-line actuator housing being disposed between said fluid powered device and a load connector, said in-line housing supporting said first and second pilot valves wherein said first pilot valve operates to provide a fluid pressure necessary to actuate a first portion of said control valve so that fluid pressure is introduced into said fluid powered device on the front side of said piston, wherein said second pilot valve operates to provide a fluid pressure necessary to actuate a second portion of said control valve so that fluid pressure is introduced into said fluid powered device on the back side of said piston; and an elongated sleeve being axially slidably mounted over said in-line housing, said elongated sleeve is coupled to a radially extending actuating member whereby movement of the sleeve in one direction operates said first pilot valve and movement of the sleeve in the opposite direction operates said second pilot valve.

2. The control assembly of claim 1 wherein said fluid control valve is a dual pilot 4 way valve assembly.

3. The control assembly of claim 1 wherein the elongated sleeve is cylindrical.

4. The control assembly of claim 1 wherein the fluid supply source is a compressed air supply.

5. A hand held actuator assembly for remotely actuating a fluid control valve having an inlet in communication with a fluid supply source and an outlet in communication with a fluid powered device, said fluid control valve being in further communication with at least one adjustable flow control, said fluid powered device having a pressure driven piston disposed therein, said pressure driven piston having a front side and a back side, said actuator assembly having a first and a second pilot valve, said first and second pilot valves having inlets in communication with said fluid supply source and outlets in communication with said control valve, wherein the improvement in said assembly comprises:

a hand held housing disposed with said first and second pilot valves, said first pilot valve operates to provide a fluid pressure necessary to actuate a first portion of said control valve so that fluid pressure is introduced into said fluid powered device on said front side of said piston, said second pilot valve operates to provide a fluid pressure necessary to actuate a second portion of said control valve so that fluid pressure is introduced into said fluid powered device on said back side of said piston;

a first actuator in communication with said first pilot valve whereby actuation causes the first pilot valve to operate causing said fluid powered device to move in a first direction; and a second actuator in communication with said second pilot valve whereby actuation causes the second pilot valve to operate causing said fluid powered device to move in a second direction opposite of said first direction.

6. The hand held assembly of claim 5 wherein said fluid control valve is a dual pilot four-way valve assembly.

7. The hand held assembly of claim 5 wherein said first and second pilot valve conduct communication with said valve assembly through a low pressure three hose ribbon.

8. The hand held assembly of claim 5 wherein said first and second actuators are mechanical thumb levers.

9. An actuator assembly for use with a fluid control valve having an inlet in communication with a fluid supply source and an outlet in communication with a fluid powered device, said fluid powered device having a pressure driven piston disposed therein, said pressure driven piston having a front side and a back side, said actuator assembly having a first and a second pilot valve, said first and second pilot valves having inlets in communication with said fluid supply source and outlets in communication with said control valve, wherein the improvement in said assembly comprises:

an in-line actuator housing, said in-line housing supporting said first and second pilot valves wherein said first pilot valve operates to provide a fluid pressure necessary to actuate a first portion of said control valve so that fluid pressure is introduced into said fluid powered device on the front side of said piston, wherein said second pilot valve operates to provide a fluid pressure necessary to actuate a second portion of said control valve so that fluid pressure is introduced into said fluid powered device on said back side of said piston; and an elongated sleeve being axially mounted over said in-line housing whereby movement of the sleeve in one direction operates said first pilot valve and movement of the sleeve in the opposite direction operates said second pilot valve.

10. The assembly of claim 9, further comprising an actuating member and wherein said elongated sleeve is coupled to said actuating member.

11. The assembly of claim 9 wherein said elongated sleeve includes a first and a second end and an opening that is defined between said first and second end.

12. The assembly of claim 10, further comprising an actuator member adapted to be positioned within said opening of said elongated sleeve.

* * * * *

UNITED STATES PATENT AND TRADEMARK OFFICE

CERTIFICATE OF CORRECTION

PATENT NO. : 6,595,104 B2
DATED : July 22, 2003
INVENTOR(S) : William Pinciaro

It is certified that error appears in the above-identified patent and that said Letters Patent is hereby corrected as shown below:

Title page,
Item [73], Assignee, replace "Tri Motion" with -- Tri-Motion --.

Column 4,
Line 33, after "causing" delete "cause".

Signed and Sealed this

Third Day of February, 2004

JON W. DUDAS
*Acting Director of the United States Patent and Trademark Office*